US006454396B2

(12) United States Patent
Silverbrook

(10) Patent No.: US 6,454,396 B2
(45) Date of Patent: Sep. 24, 2002

(54) MICRO ELECTRO-MECHANICAL SYSTEM WHICH INCLUDES AN ELECTROMAGNETICALLY OPERATED ACTUATOR MECHANISM

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/864,343

(22) Filed: May 25, 2001

Related U.S. Application Data

(63) Continuation-in-part of application No. 09/113,061, filed on Jul. 10, 1998, now Pat. No. 6,247,794.

(30) Foreign Application Priority Data

Jul. 15, 1997 (AU) ..... PO8049

(51) Int. Cl.[7] ..... B41J 2/04
(52) U.S. Cl. ..... 347/54

(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS 5,612,723 A 3/1997 Shimura et al.

*Primary Examiner*—Raquel Yvette Gordon

(57) ABSTRACT

A micro electro-magnetic system includes a substrate. An actuator mechanism is arranged on the substrate. An actuator arm is displaceably mounted on the substrate and is displaceable with respect to the substrate along a predetermined path of travel. The actuator arm has a plurality of spaced magnetic poles along its length. An electromagnetic field generator is operatively positioned with respect to the actuator arm and is capable of producing an electromagnetic field of sufficient strength to interact with the spaced magnetic poles so that the actuator arm is displaced along the path of travel. A control system is provided for controlling operation of the electromagnetic field generator.

9 Claims, 3 Drawing Sheets

MICRO ELECTRO-MECHANICAL SYSTEM WHICH INCLUDES AN ELECTROMAGNETICALLY OPERATED ACTUATOR MECHANISM

CROSS REFERENCED AND RELATED APPLICATIONS

This application is a continuation-in-part application of U.S. application Ser. No. 09/113,061 filed Jul. 10, 1998, now U.S. Pat. No. 6,247,794. U.S. patent application Ser. No. 09/113,061 is hereby incorporated by reference.

BACKGROUND OF THE INVENTION

The applicant has invented a large number of micro electro-mechanical devices in the field of printing technology. These devices are manufactured by a technique based on integrated circuit fabrication.

In particular, the applicant has invented an ink jet printhead which is capable of producing text and images at a resolution up to 1600 dpi. These printheads can incorporate up to 84000 nozzle arrangements in a single printhead chip. As a result of the applicant's knowledge and experience in this field, the applicant has found that there exists a general need for an electromagnetically operated actuator which will have application in a wide variety of micro electro-mechanical devices.

In particular, the applicant has identified a need for such an actuator which is capable of being fabricated in accordance with a technique based on integrated circuit fabrication. It will be appreciated by those skilled in the field that such techniques are based on successive deposition and selective etching processes.

SUMMARY OF THE INVENTION

According to a first aspect of the invention, there is provided a micro electro-mechanical system which is the product of an integrated circuit fabrication technique comprising a substrate; and an actuator mechanism arranged on the substrate and comprising an actuator arm that is displaceably mounted on the substrate and which is displaceable with respect to the substrate along a predetermined path of travel, the actuator arm having a plurality of spaced magnetic poles along its length;

an electromagnetic field generator that is operatively positioned with respect to the actuator arm and which is capable of producing an electromagnetic field of sufficient strength to interact with the spaced magnetic poles so that the actuator arm is displaced along the path of travel; and a control system for controlling operation of the electromagnetic field generator.

According to a second aspect of the invention, there is provided an ink jet printhead which is the product of an integrated circuit fabrication technique comprising a substrate; and an actuator mechanism arranged on the substrate and comprising an actuator arm that is displaceably mounted on the substrate and which is displaceable with respect to the substrate along a predetermined path of travel, the actuator arm having a plurality of spaced magnetic poles along its length;

an electromagnetic field generator that is operatively positioned with respect to the actuator arm and which is capable of producing an electromagnetic field of sufficient strength to interact with the spaced magnetic poles so that the actuator arm is displaced along the path of travel; and a control system for controlling operation of the electromagnetic field generator.

The invention is now described, by way of example only, with reference to the accompanying drawings. The specific nature of the following description should not be construed as limiting, in any way, the broad nature of the above summary.

DETAILED DESCRIPTION OF THE INVENTION

Figure 1:
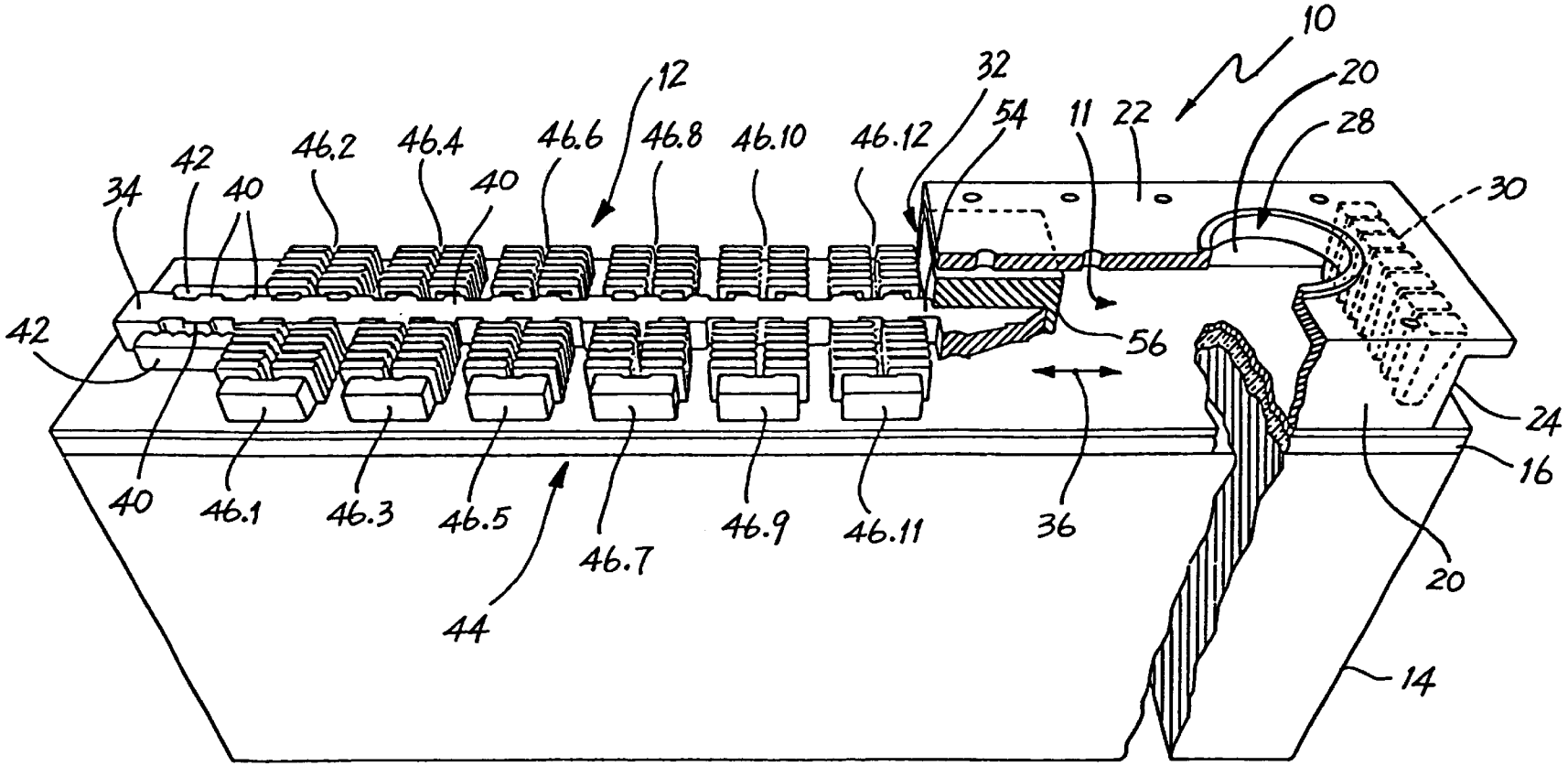
FIG. 1 shows a partially sectioned view of an actuator mechanism of a micro electro-mechanical system, in accordance with the invention, in a printing application.

In FIG. 1, reference numeral 10 generally indicates a nozzle arrangement in the form of a micro electro-mechanical system, in accordance with the invention, which includes an actuator mechanism, generally indicated at 12.

The nozzle arrangement 10 includes a wafer substrate 14 prepared in accordance with an integrated circuit fabrication technique. A drive circuitry layer 16 is positioned on the wafer substrate 14 and is connected to a control system 18.

A pair of opposed side walls 20, a roof wall 22 and an end wall 24 are arranged on the layer 16 to define a nozzle chamber 26. The roof wall 22 defines an ink ejection port 28 which is in fluid communication with the nozzle chamber 26.

The end wall 24 is in the form of a grilled structure 30 to filter ink entering the nozzle chamber 24 via the grilled structure 30. An opening 32 is defined opposite the grilled structure 30.

The actuator mechanism 12 includes an actuator arm 34 that is displaceably mounted on the substrate 14 and which is displaceable with respect to the substrate 14 along a predetermined path of travel.

Figure 2:
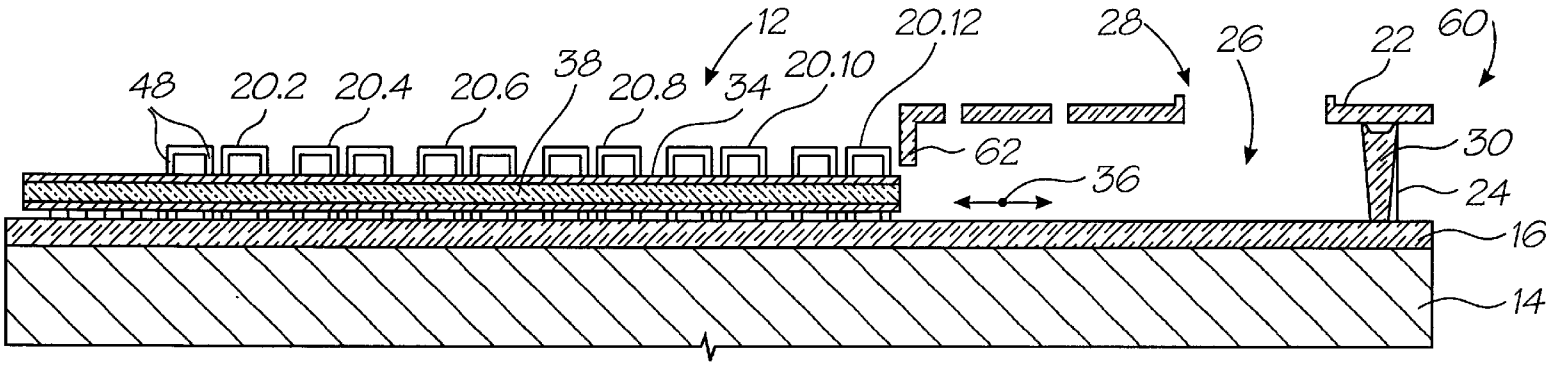
FIG. 2 shows a schematic sectioned view of the actuator mechanism also in a printing application.
Figure 3:
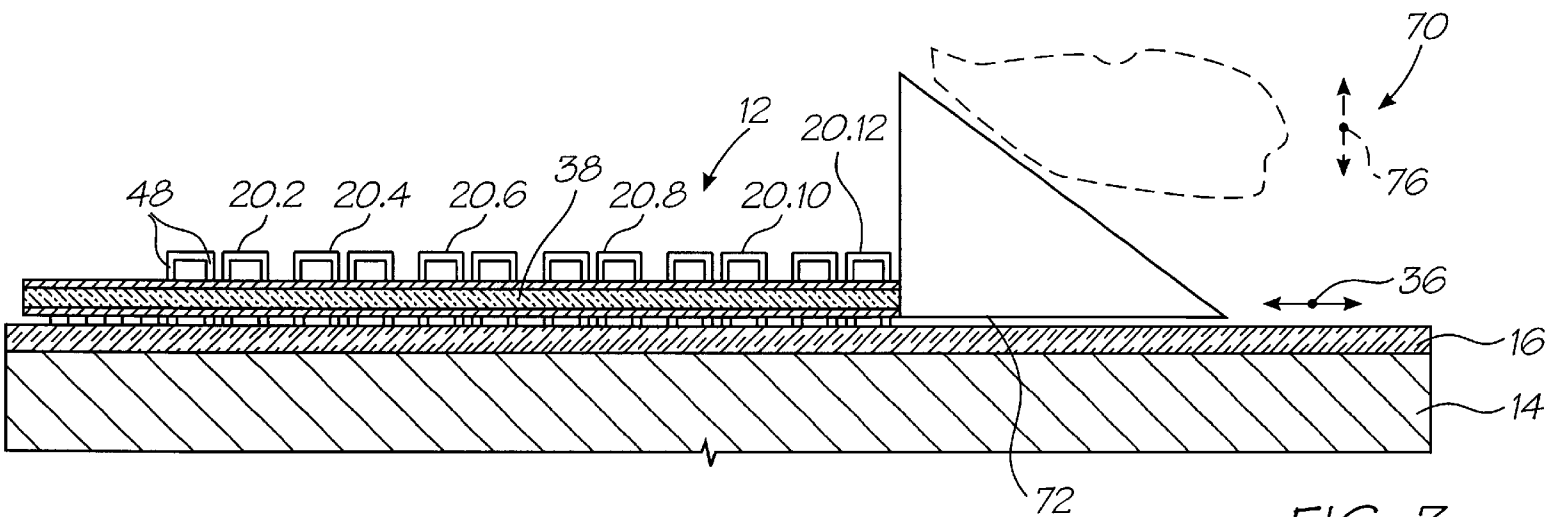
FIG. 3 shows the actuator mechanism in an application based on simple mechanical displacement.

The actuator arm 34 has a linear configuration so that the actuator arm 34 travels in a generally linear direction as indicated by the double headed arrows 36 in FIGS. 2 and 3.

The actuator arm 34 has a soft magnetic core 38 and defines a plurality of regularly spaced, opposed pairs of magnetic poles 40.

A pair of guide formations 42 are positioned on the substrate 14 to guide the actuator arm 34 along its path of travel.

The actuator mechanism 12 includes an electromagnetic field generator 44 which is connected to drive circuitry within the drive circuitry layer 16 to generate an electromagnetic field which is of sufficient strength to result in displacement of the actuator arm 34. The electromagnetic field generator is in the form of six pairs of opposed electromagnets, each having a pair of poles 48, each pole 48 corresponding with a magnetic pole 46 of the actuator arm 34. Each electromagnet 46 has a soft iron core 50 surrounded with a coil 52. Each coil 52 is connected to circuitry within the drive circuitry layer so that each core 50 can be magnetized. It will also be appreciated that, with suitable drive circuitry, current within the coils 52 can be reversed, thereby switching polarity within the poles 48.

The control system 18 is configured so that the electromagnets 46 can be controlled to generate linear stepped movement of the actuator arm 34. In particular, the control system 18 is configured so that the electromagnets 46 are activated in three phases. For example, in this particular configuration, electromagnets 46.1, 46.2, 46.7 and 46.8 are driven in a first phase, electromagnets 46.3, 46.4, 46.9 and 46.10 are driven in a second phase and electromagnets 46.5, 46.6, 46.11 and 46.12 are driven in a third phase.

It will readily be appreciated that an advantageous extent of control over movement of the actuator arm 34 can be achieved with a suitable configuration of the control system 18 and the drive circuitry embedded in the layer 16. In particular, it will be appreciated that the movement of the actuator arm 34 can be controlled with a series of digital pulses generated by the control system 18.

A working end 54 of the actuator arm 34 has a plunger 56 positioned thereon. The plunger 56 is received in the opening 32. The plunger 56 is displaceable towards and away from the grilled structure 30 on displacement of the actuator arm 34, as described above.

It will thus be appreciated that the actuator mechanism 12 can be used to eject ink from the ink ejection port 28. In particular, it will be appreciated that the actuator mechanism 12 can be used to achieve a digitally variable ink drop volume by controlling the number of digital pulses used to achieve displacement of the actuator arm 34.

In FIG. 2, reference numeral 60 generally indicates a further embodiment of a nozzle arrangement of a micro electro-mechanical system, in accordance with the invention, incorporating the actuator mechanism 12. With reference to FIG. 1, like reference numerals refer to like parts, unless otherwise specified.

Instead of the plunger 50, a nozzle wall 62 is mounted on the working end 54 of the actuator arm 34. Thus, on displacement of the nozzle wall 62 on operation of the actuator mechanism 12, towards the grill structure 30, ink is ejected from the ink ejection port 28.

Figure 4:
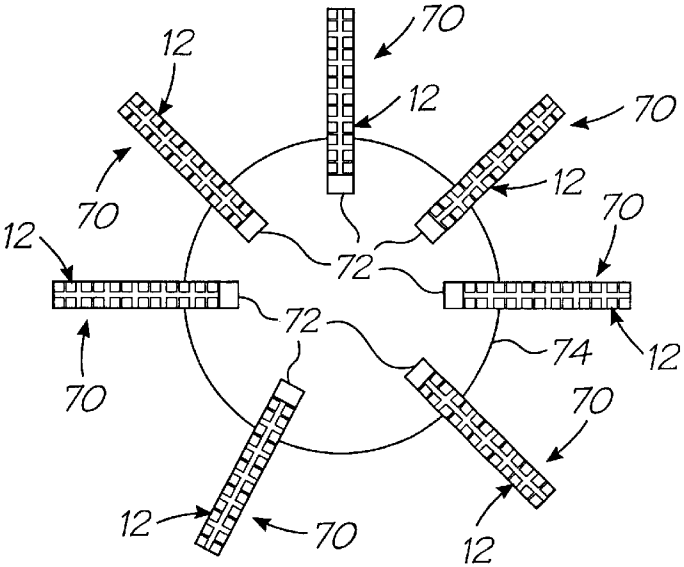
FIG. 4 shows a plurality of the actuator mechanisms of FIG. 3 as applied to a micro-deformable mirror.
Figure 5:
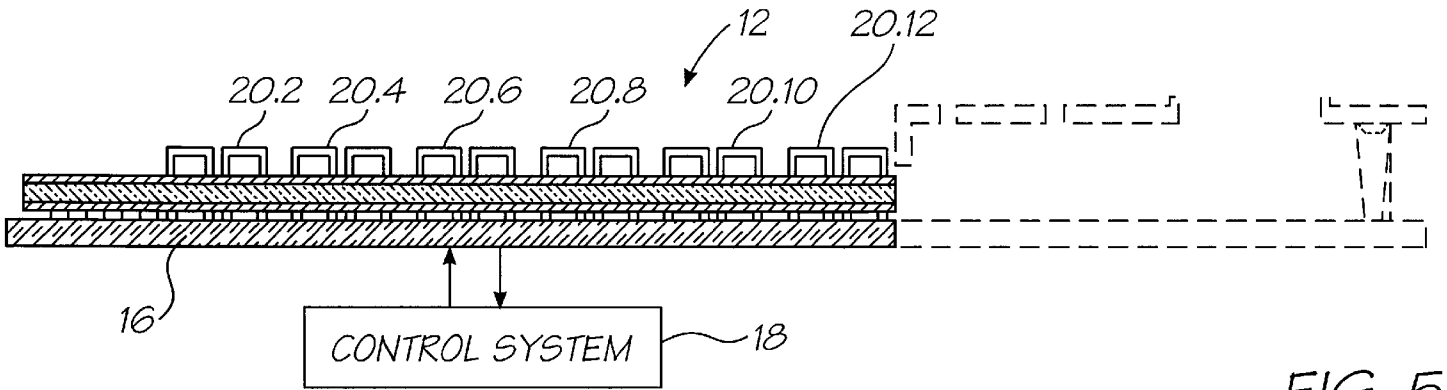
FIG. 5 shows a portion of the actuator mechanism of FIGS. 1, 2 and 3.

In FIGS. 3 and 4, reference numeral 70 generally indicates a micro electro-mechanical system, in accordance with the invention.

In this case, the actuator mechanism 12 incorporates a prime mover 72 positioned on the working end 54 of the actuator arm 34.

In this particular example, the prime mover 72 is engageable with a micro-deformable mirror 74. Such mirrors are used to achieve a consistent focal point when reflecting signals having inconsistent frequencies. It will be appreciated that the high level of control that can be achieved by the actuator mechanism 12 is extremely advantageous when used to adjust a reflective surface of the mirror 74.

The prime mover 72 acts, as shown in FIG. 3, on the mirror 74 to create a deflection as shown by the double headed arrow 76 in FIG. 3.

As can be seen in FIG. 4, a plurality of the actuator mechanisms 12 incorporating the prime mover 72 can be positioned about the mirror 74. This allows for independent adjustment of the relative positions of various portions of the reflective surface of the mirror 74.

In view of the above description, a particular advantage of the present invention is the fact that it provides a means whereby a high level of control over movement of an actuator can be achieved. In particular, this high level of control can be achieved at a scale in the micro electro-mechanical systems range.

A further advantage of the invention is that the configuration of the actuator mechanism permits the actuator mechanism to have a relatively large extent of travel with a high level of thrust when compared with other devices in the micro electro-mechanical systems range. The level of thrust can readily be adjusted by configuration of the control system 18.

I claim:

1. A micro electro-mechanical system which is the product of an integrated circuit fabrication technique comprises a substrate; and an actuator mechanism arranged on the substrate and comprising an actuator arm that is displaceably mounted on the substrate and which is displaceable with respect to the substrate along a predetermined path of travel, the actuator arm having a plurality of spaced magnetic poles along its length;

an electromagnetic field generator that is operatively positioned with respect to the actuator arm and which is capable of producing an electromagnetic field of sufficient strength to interact with the spaced magnetic poles so that the actuator arm is displaced along the path of travel; and a control system for controlling operation of the electromagnetic field generator.

2. A micro electro-mechanical system as claimed in claim 1, in which the actuator arm has a linear configuration with the predetermined path also being linear so that that the actuator arm travels in a generally linear direction.

3. A micro electro-mechanical system as claimed in claim 2, which includes a guide formation arranged on the substrate to guide the actuator arm along the predetermined path of travel.

4. A micro electro-mechanical system as claimed in claim 1, in which the electromagnetic field generator is in the form of a series of actuable electromagnets positioned along the substrate and having magnetic poles which correspond with the magnetic poles on the actuator arm.

5. A micro electro-mechanical system as claimed in claim 4, in which the electromagnets are positioned on each side of the predetermined path.

6. A micro electro-mechanical system as claimed in claim 4, in which the electromagnets are connected to drive circuitry on the substrate to provide the electromagnets with an electrical current when required, the drive circuitry being operatively connected to the control system.

7. A micro electro-mechanical system as claimed in claim 6, in which the control system is configured to energize the electromagnets in a phased manner so that the actuator arm undergoes linear stepped movement.

8. A micro electro-mechanical system as claimed in claim 1, in which the actuator arm has a working end which is engageable with a prime mover.

9. An ink jet printhead which is the product of an integrated circuit fabrication technique comprises a substrate; and an actuator mechanism arranged on the substrate and comprising an actuator arm that is displaceably mounted on the substrate and which is displaceable with respect to the substrate along a predetermined path of travel, the actuator arm having a plurality of spaced magnetic poles along its length;

an electromagnetic field generator that is operatively positioned with respect to the actuator arm and which is capable of producing an electromagnetic field of sufficient strength to interact with the spaced magnetic poles so that the actuator arm is displaced along the path of travel; and a control system for controlling operation of the electromagnetic field generator.

* * * * *